US007861664B2

(12) United States Patent
Wichard et al.

(10) Patent No.: US 7,861,664 B2
(45) Date of Patent: Jan. 4, 2011

(54) TOY DOOR KNOCKER, AND CONSTRUCTION AND EDUCATIONAL KITS INCLUDING A DOOR KNOCKER

(75) Inventors: Sheree Wichard, Brooklyn, NY (US); Donel Young, Point Pleasant, NJ (US)

(73) Assignee: Knockwood, Inc., Pt. Pleasant, NJ (US)

( * ) Notice: Subject to any disclaimer, the term of this patent is extended or adjusted under 35 U.S.C. 154(b) by 15 days.

(21) Appl. No.: 12/186,902

(22) Filed: Aug. 6, 2008

(65) Prior Publication Data

US 2009/0038533 A1 Feb. 12, 2009

Related U.S. Application Data

(60) Provisional application No. 60/954,097, filed on Aug. 6, 2007.

(51) Int. Cl.
*G08B 3/00* (2006.01)
*E06B 7/28* (2006.01)

(52) U.S. Cl. ..... 116/148; 116/DIG. 12

(58) Field of Classification Search ..... 116/148, 116/167, DIG. 12; 340/328, 396.1, 691.1
See application file for complete search history.

(56) References Cited

U.S. PATENT DOCUMENTS

| | | | | | |
|---|---|---|---|---|---|
| D115,221 | S | * | 6/1939 | Stevens | D8/401 |
| 2,295,369 | A | * | 9/1942 | Thompson | 362/95 |
| 2,405,916 | A | * | 8/1946 | Neuhaus | 116/167 |
| 2,747,538 | A | * | 5/1956 | Morse, Jr. et al. | 116/148 |
| D225,964 | S | * | 1/1973 | Ballou | D8/401 |
| 3,734,054 | A | * | 5/1973 | Anderson | 116/148 |
| 3,978,189 | A | * | 8/1976 | Einhorn | 264/229 |
| 5,417,604 | A | | 5/1995 | Rafelman et al. | |
| 5,570,083 | A | * | 10/1996 | Johnson | 340/692 |
| 5,814,379 | A | * | 9/1998 | Roccaforte | 428/5 |
| D403,238 | S | * | 12/1998 | Burris | D8/401 |
| 5,900,802 | A | * | 5/1999 | Segan | 340/328 |
| 5,973,591 | A | * | 10/1999 | Schwartz et al. | 340/384.7 |
| 6,149,117 | A | * | 11/2000 | Shao | 248/316.3 |
| 6,285,294 | B1 | | 9/2001 | Avinger | |
| 6,324,261 | B1 | * | 11/2001 | Merte | 379/68 |
| 6,721,408 | B1 | * | 4/2004 | Bain et al. | 379/159 |
| 7,591,569 | B1 | * | 9/2009 | Little | 362/311.13 |
| 2006/0187020 | A1 | * | 8/2006 | Smithkovec-Chilton et al. | 340/531 |
| 2007/0144426 | A1 | * | 6/2007 | Lo | 116/167 |

FOREIGN PATENT DOCUMENTS

JP 08068277 A * 3/1996

* cited by examiner

*Primary Examiner*—R. A. Smith

(57) ABSTRACT

Modular constructional toy kit and instructional story book, for use in forming a customized and personalized privacy guard in the form of a door knocker and learning the importance of protecting and respecting a persons right to privacy. The constructional toy kit allows children to build and decorate their own door knockers. Each door knocker has a base unit and a pivotal member hinged at one end to the base unit allowing the pivotal member to swing in a short arc away from the base unit. When released, the pivotal member swings back to make contact with the base unit emitting a loud sound. The constructional toy kit can also have an integrated holder to store written messages, integrated electronic recording and playback device for personalized audio messages, a smooth flat surface at the lower portion of the base unit suitable for imprinting a child's name, assorted decorations and attachable components to allow for the creation of animals or creatures, paints and commercially available hardware and adhesives.

7 Claims, 8 Drawing Sheets

• CORD LEGS ALLOW FOR DANGLING & KNOCKING WITH BACK OF FOOT

MONSTER MADNESS

TOY DOOR KNOCKER, AND CONSTRUCTION AND EDUCATIONAL KITS INCLUDING A DOOR KNOCKER

CROSS-REFERENCE TO RELATED APPLICATION

This application claims priority to U.S. Provisional Application No. 60/954,097, which was filed on Aug. 6, 2007 incorporated herein by reference in its entirety.

FIELD OF THE INVENTION

The present invention generally relates to a door knocker, particularly a toy door knocker, and a construction and educational kit including a door knocker.

BACKGROUND OF THE INVENTION

Conventional door knockers where an arm is supported by a base or ornamental door plaques are made of heavy metal to produce the required tapping noise and are used for entrance doors of a house only. Children of all ages are taught to knock on the door of a parents' and/or siblings' room before entering. Children are also encouraged to seek permission before entering another persons home but conventional door knockers made of metal or plastic are heavy and unattractive for use within a house, school or any building. Further these door knockers only serve the purpose of producing noise and are not interactive for children to learn issues such as privacy.

Thus, there is a need to create a door knocker, particularly a toy door knocker that can not only serve as a traditional door knocker but is also a construction and educational kit. All of the above mentioned disadvantages of the prior art are addressed and overcome in the present invention which is described below.

BRIEF SUMMARY OF THE INVENTION

A door knocker such as a toy door knocker for children, is provided. The door knocker can be made generally in the shape of a motif (e.g., a dog, monster, owl, butterfly, robot, dinosaur, pirate, princess, skateboarder, etc.) and comprise a base unit and a knocking unit. The knocking unit is movable in relation to the base unit and makes a sound when being brought in contact with the base unit. The door knocker can also include one or more interactive structures, such as a name plate to show the child's name, a message center for the child and the visitor to leave messages for each other. The door knocker can be made of wood.

A door knocker construction kit is also provided, in which the various components are made to be readily assembled. For example, each component of the door knocker can be formed with one or more connectors to be joined with other components either by hand or by an assembly tool, which can be included in the construction kit. Additionally or alternatively, the construction kit can include a plurality of interchangeable parts for one or more components of the door knocker. For example, a plurality of motif parts can be included in the construction kit, each being designed as a different character (e.g., a dog, monster, owl, butterfly, dinosaur, pirate, princess, skateboarder, etc.) or a different decor for different seasons or holidays, such as Halloween, Thanksgiving, and Christmas. Each motif part is made to be readily assembled to the remaining parts of the door knocker.

A door knocker educational kit is additionally provided which includes a door knocker and literature components about privacy. The door knocker can be in the form of a construction kit. The modular constructional kit and instructional story book form a customized and personalized privacy guard in the form of a door knocker and teach children the importance of protecting and respecting a person's right to privacy. The educational kit will allow children to build and decorate their own door knockers, read and learn about invaluable lessons about privacy, interact and play with family and friends during the learning process, and experience privacy.

DETAILED DESCRIPTION OF THE PREFERRED EMBODIMENT

This invention allows a parent and a child to interact and work together to construct a door knocker that will provide a vehicle to teach the theory of privacy and the importance of respecting personal privacy. The construction and educational kits may contain a plurality of components necessary to construct a personalized and uniquely custom door knocker. In addition, a story book linked to the particular theme of the doorknocker relating a creative story about privacy, which will give parents and or caretakers a vehicle to discuss the topic, may be included in the educational kit.

Figure 1A:
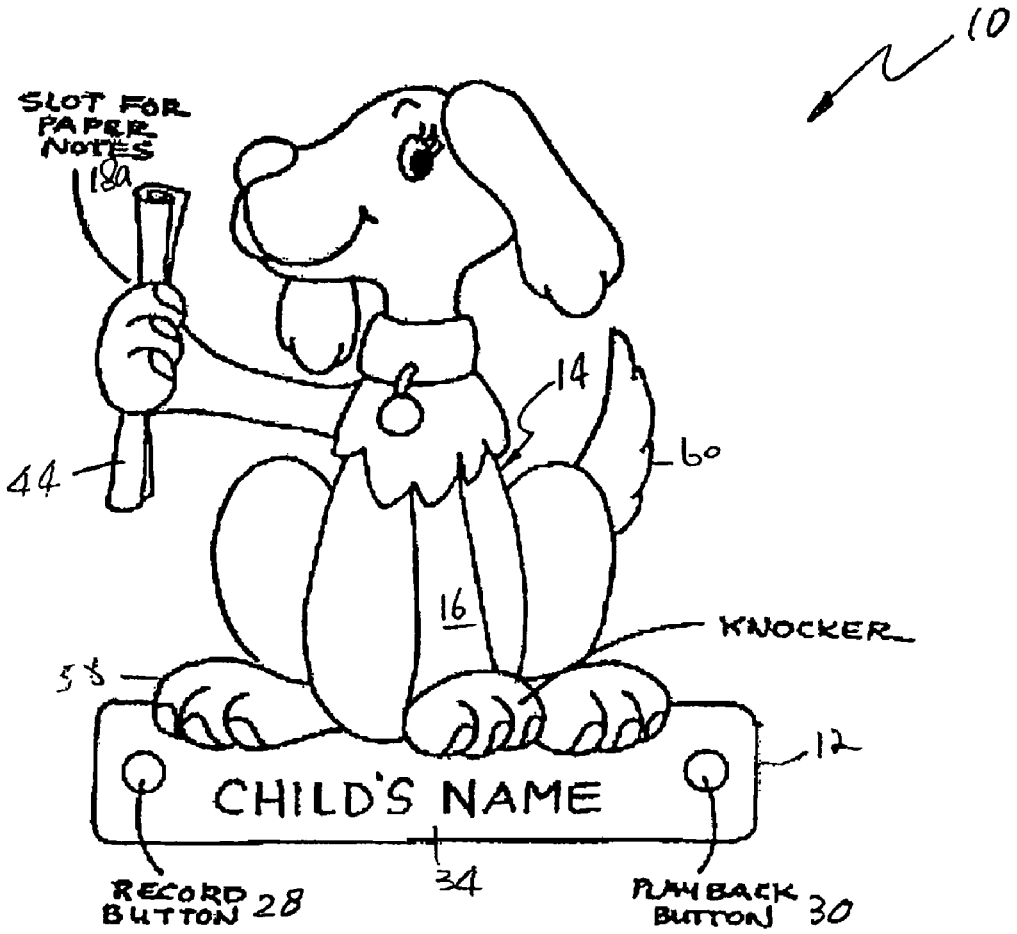
FIGS. 1A and 1B show a plane view of a door knocker formed according to a first embodiment.
Figure 1B:
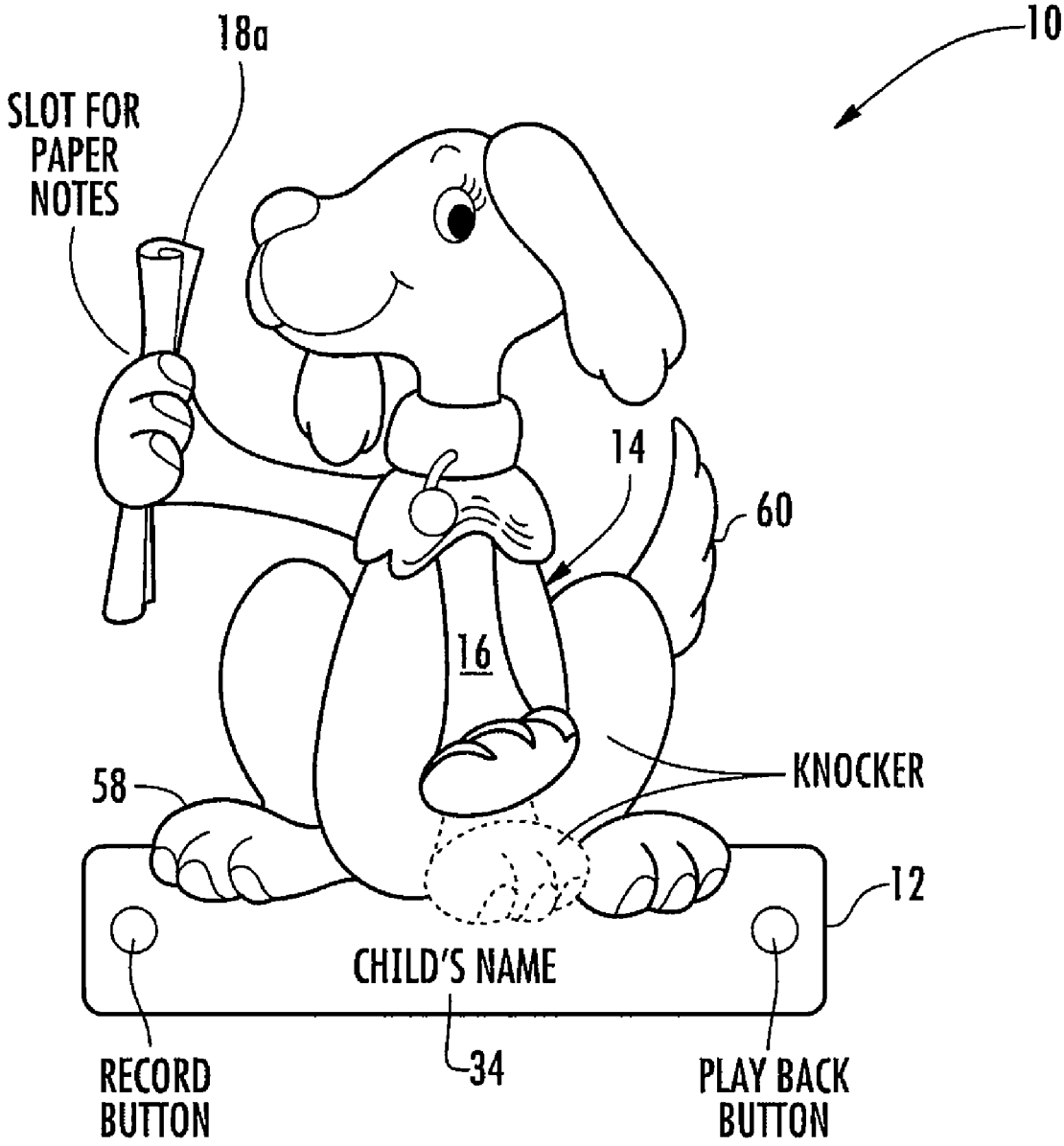
Figure 2:
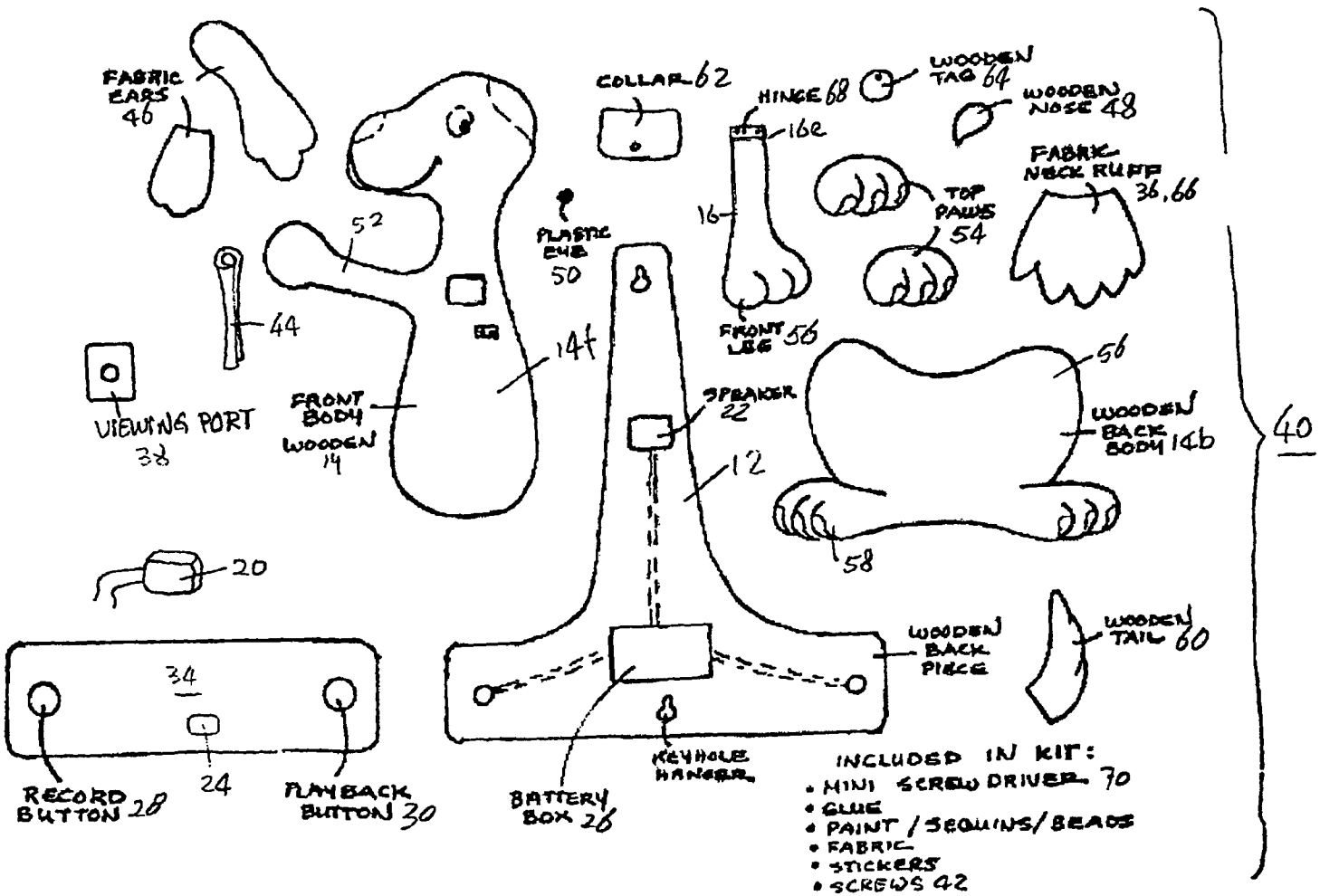
FIG. 2 shows a construction kit including a door knocker of FIGS. 1A and 1B.

FIGS. 1A, 1B, and 2 show a first embodiment of a door knocker 10. The door knocker 10 can comprise a base unit 12 (see FIG. 2) for mounting the door knocker 10 onto a door, such as a child's bedroom door. The main body portion 14 of the door knocker 10 can be configured as a motif, such as a dog, monster, owl, butterfly, dinosaur, pirate, princess, skateboarder, etc. The door knocker 10 can be made of primarily wood and finished with non-toxic paints or other finishes.

The main body portion 14 can comprise a knocking member 16 movably joined to the remaining main body portion 14. As FIG. 1B shows, the knocking member 16 (e.g., the front leg of the character) can be lifted or otherwise moved away from its resting position (shown by dotted lines) prior to knocking. For example, the knocking member 16 can be hinged at one end 16*e* to the main body portion 14 to allow the knocking member 16 to swing away from the main body portion 14 and/or the base unit 12. In an example shown in FIG. 2, one of the front legs 56 of the character (e.g., a dog) can be formed as a knocking member 16 and hinged to the main body portion 14 at the upper portion of the front leg 56. When the knocking member 16 is made to contact with the main body portion 14 and/or the base unit 12, a loud sound is emitted to notify the child of a visitor.

The door knocker 10 can include various interactive elements. For example, when the door knocker 10 is in the shape of an owl, the owl's eyes can light up when a visitor uses the door knocker 10. In another example, the door knocker 10 can include a message center 18, such as a message holder 18*a* where visitors can leave notes. In one example, a character's hand can be formed as a message holder 18*a*. In a further example, the door knocker 10 can comprise a recording and playing back device 20 so that the child can leave a message for visitors and vice versa, etc. Such recording and playback device 20 can be a commercially available integrated circuit and include a speaker 22, microphone 24, battery compartment 26, recording switch 28, playback trigger 30, and on-off switch 32 (see FIGS. 3A, 3B, and 6).

Additionally or alternatively, the door knocker 10 can include one or more additional accessory components. For example, a label plate 34 can be provided, such as at the lower portion of the base unit 12 to show the child's name or other logo or statement. In another example, a shield member 36 can be provided to cover the hinged portions of the knocking member 16. In a further example, an eye piece 38 can be provided for the child to view from inside of the door who is knocking at the door. For example, the viewing port 38 can be mounted on the door knocker 10 at the same position where the eye of the animal motif is. One or more assorted decorations and attachable components can be provided to allow for the creation of animals or creatures, paints and commercially available hardware and adhesives.

A label plate 34 can be provided, such as to be personalized with a child's name (e.g., "Josh's Room"). The label plate 34 can have a smooth flat surface 34*s*, such as formed at the lower portion of the door knocker 10. The name can be fixed on the label plate 34 in various ways. For example, the name can be painted, carved onto the label plate 34. In one example, the label plate 34 is in the form of a name plate containing a slot for holding a name label. In one example, the label plate 34 can have a height of about one inch and runs horizontally the full width of base unit 12. In another example, the electronic button switch 28 for start/stop the recording and the trigger switch 30 to initiate the playback can be provided on the label plate 34, as is shown in FIGS. 1A and 1B.

FIG. 2 shows a modular construction toy kit 40, which may comprise of one or more of the construction components for forming a door knocker 10 as a customized and personalized privacy guard for a user, such as a child.

The construction kit may include a base unit 12 to be mounted on a door. The base unit 12 can have various shapes, such as having an appearance of an inverted capital letter "T." The base unit 12 can be made in various sizes, such as about 9½" in height, about 8" in width, and about 2½" in depth. The base unit 12 can be formed of various materials, preferably an FSC (Forest Stewardship Council) certified wood.

The construction kit in FIG. 2 illustrates one or more connectors 42 for attaching the base unit 12 to a door. Various standard nail or screw hardware can be used for this purpose. The construction kit may include a main body portion 14 containing a front portion 14*f* and a back portion 14*b*. In one example, the main body portion 14 can comprise a back motif body portion 14*b* adapted to be mounted onto the base unit 12. For example, the back body portion 14*b* is formed to resemble a portion of the motif. The front motif body portion 14*f* can be adapted to be mounted onto the back body portion 14*b* and have a designed shape and/or contour, such as matching either an animal or creature.

A knocking member 16 movably attached to the remaining main body portion 14 may be one of the construction components. For example, the knocking member 16 is hinged at one end 16*e* to allow the knocking member 16 to swing in a short arc away from the remaining body portion 14 and/or the base unit 12. When the knocking member 16 is released, it will swing back via gravity to make contact with the remaining body portion 14 and/or the base unit 12 and generate a loud sound to notify the child of a visitor. In one example, contact of the knocking member 16 with the base unit 12 can also trigger the playback of the recorded electronic message via the integrated circuitry in the recording and playing back device 20.

FIG. 2 shows a message center 18, such as a message holder 18*a* for holding rolled paper to be used to store written messages. In one example, each construction kit 40 can also contain a pad of paper 44, which is decorated to match the theme of the door knocker 10.

The construction kit in FIG. 2 further illustrates an electronic recording and playback device 20 for personalized audio messages. Such recording and playback device 20 can be a commercially available integrated circuit and include a speaker 22, microphone 24, battery compartment 26, recording switch 28, playback trigger 30, and on-off switch 32.

FIG. 2 illustrates various shaped motif construction pieces, including one or more of each of the following: ear pieces 46, nose pieces 48, eye pieces 50, arm pieces 52, hand pieces 54, leg pieces 56, paw pieces 58, tail pieces 60, collar pieces 62, tag pieces 64, neck ruff pieces 66. In one example, one or more of the above construction pieces can be used as a knocking member 16. In an example previously described, one of the leg pieces 56 can be made into a knocking member 16. Additionally or alternatively, one of the ear pieces 46 can be formed to be movably attached to the remaining body portion 14 and function as a knocking member 16. In another example, the neck ruff 66 each can be formed as a shield member 36 so that, when the door knocker 10 is assembled, the collar piece 62 can cover the hinge connecting the front leg 56 with the remaining main body portion 14.

The example construction kit in FIG. 2 includes a viewing port 38 for the child to view from inside of the door who is knocking at the door. In one example, the viewing port 38 can be mounted on the door knocker 10 at the same position where the eye of the animal motif is. A brass hinge 68 for movably joining one or more selected motif construction pieces (e.g., a front leg 56 of a dog motif) to the remaining main body portion 14 is included. One or more assembling tools 70 including screw drivers, screws, etc maybe included. Crafting items like glue, paint, glitter, fabric, etc are shown in FIG. 2.

Figure 3A:
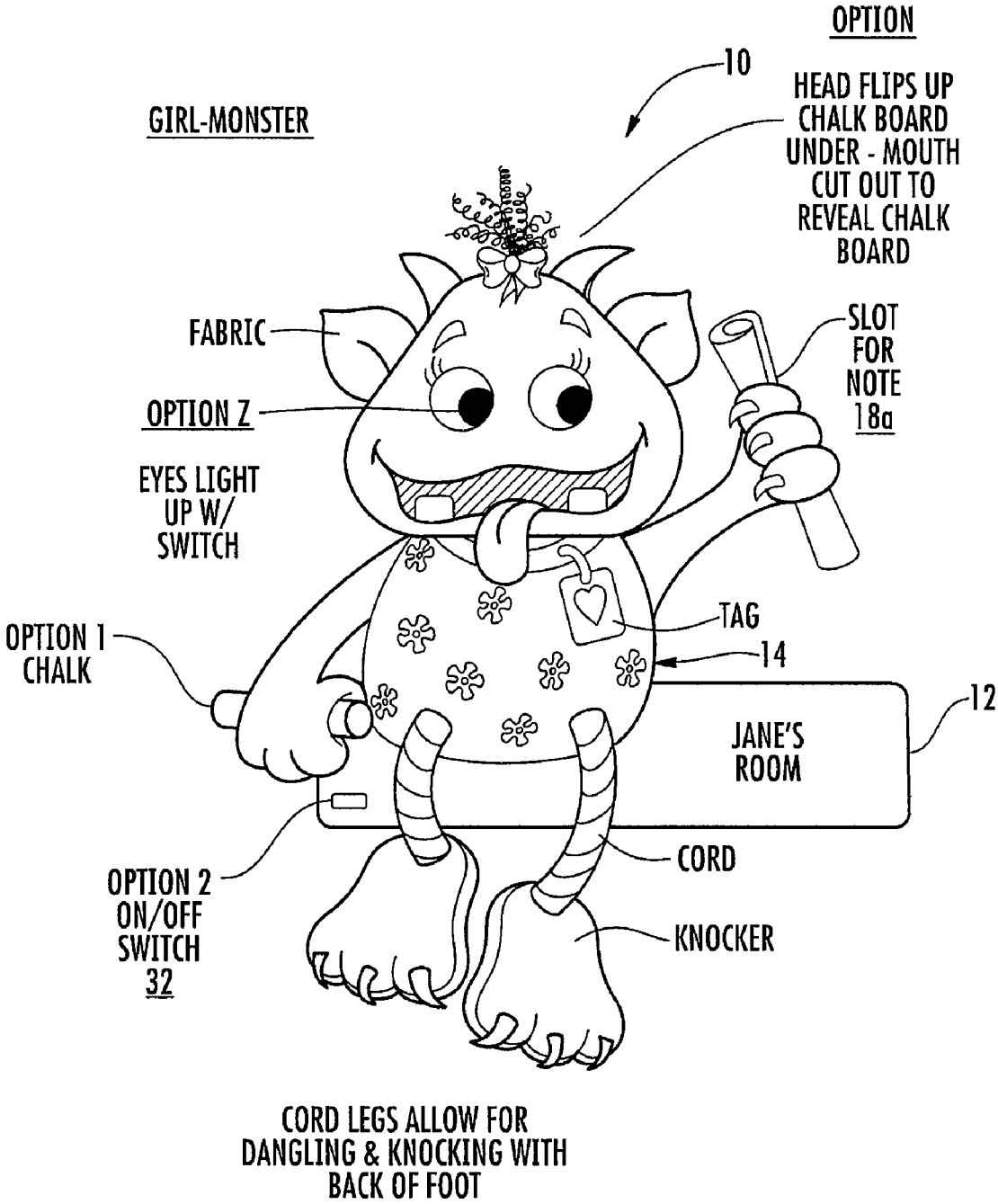
FIGS. 3A and 3B each show a plane view of a door knocker formed according to a second embodiment.
Figure 3B:
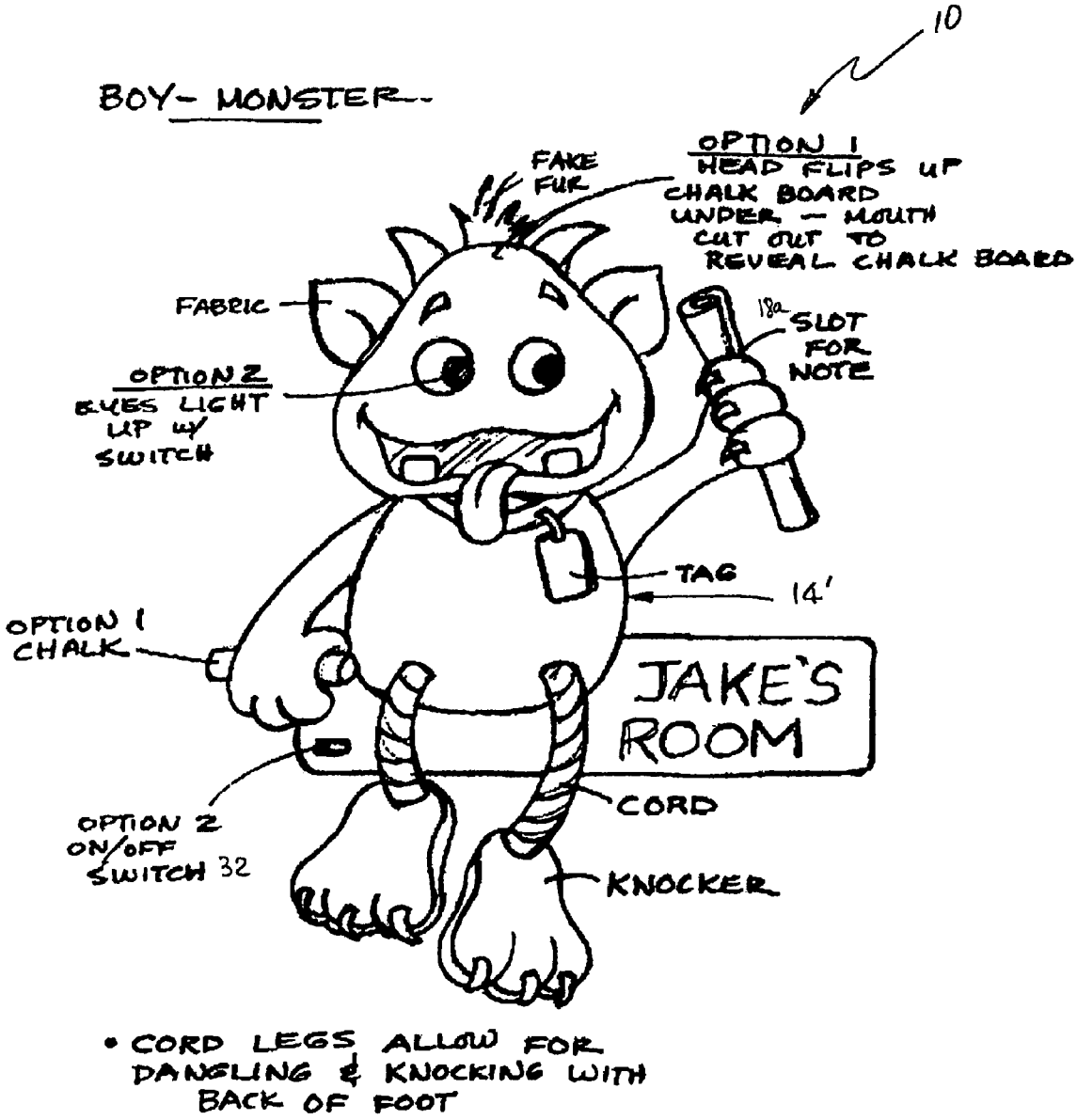
Figure 4:
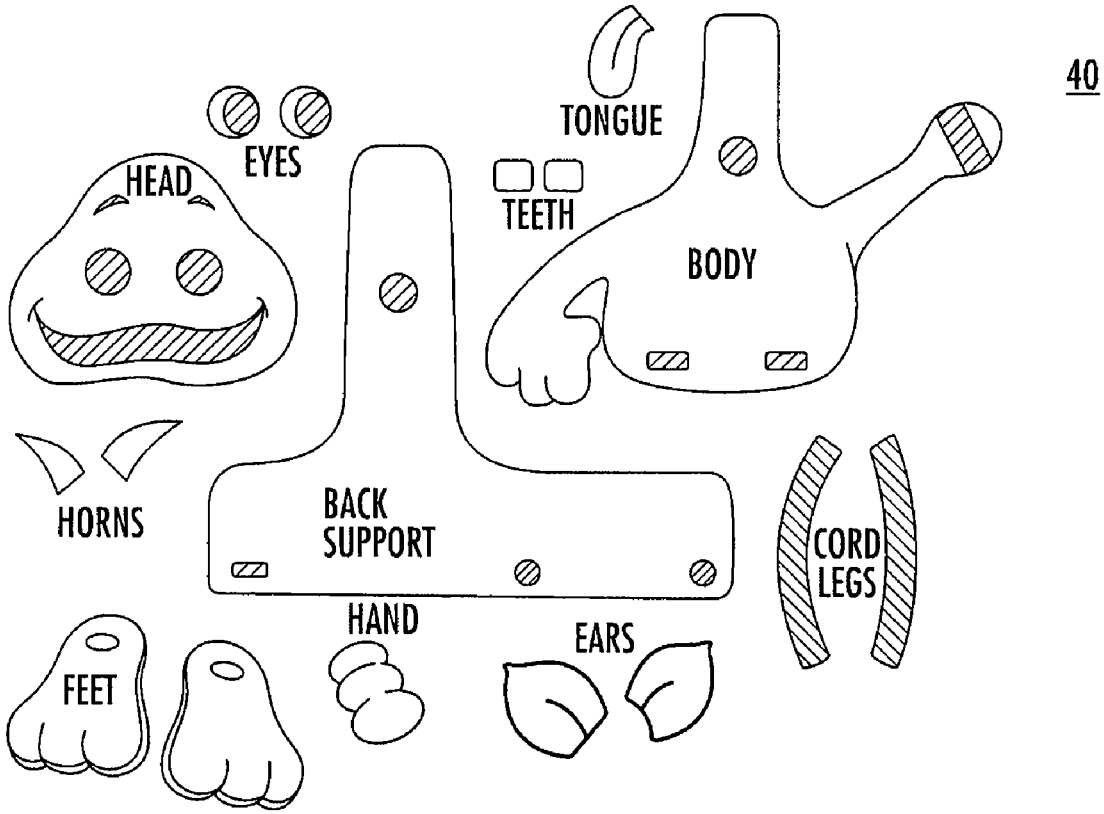
FIG. 4 shows a construction kit including a door knocker of FIGS. 3A and 3B.

FIGS. 3A, 3B, and 4 show a second embodiment of a door knocker 10 and a construction kit 40 in which the main body portion 14' is configured as a monster. The main body portions 14' shown in FIGS. 3A and 3B can be formed similarly but decorated as different characters, such as a girl monster or a boy monster.

Figure 5:
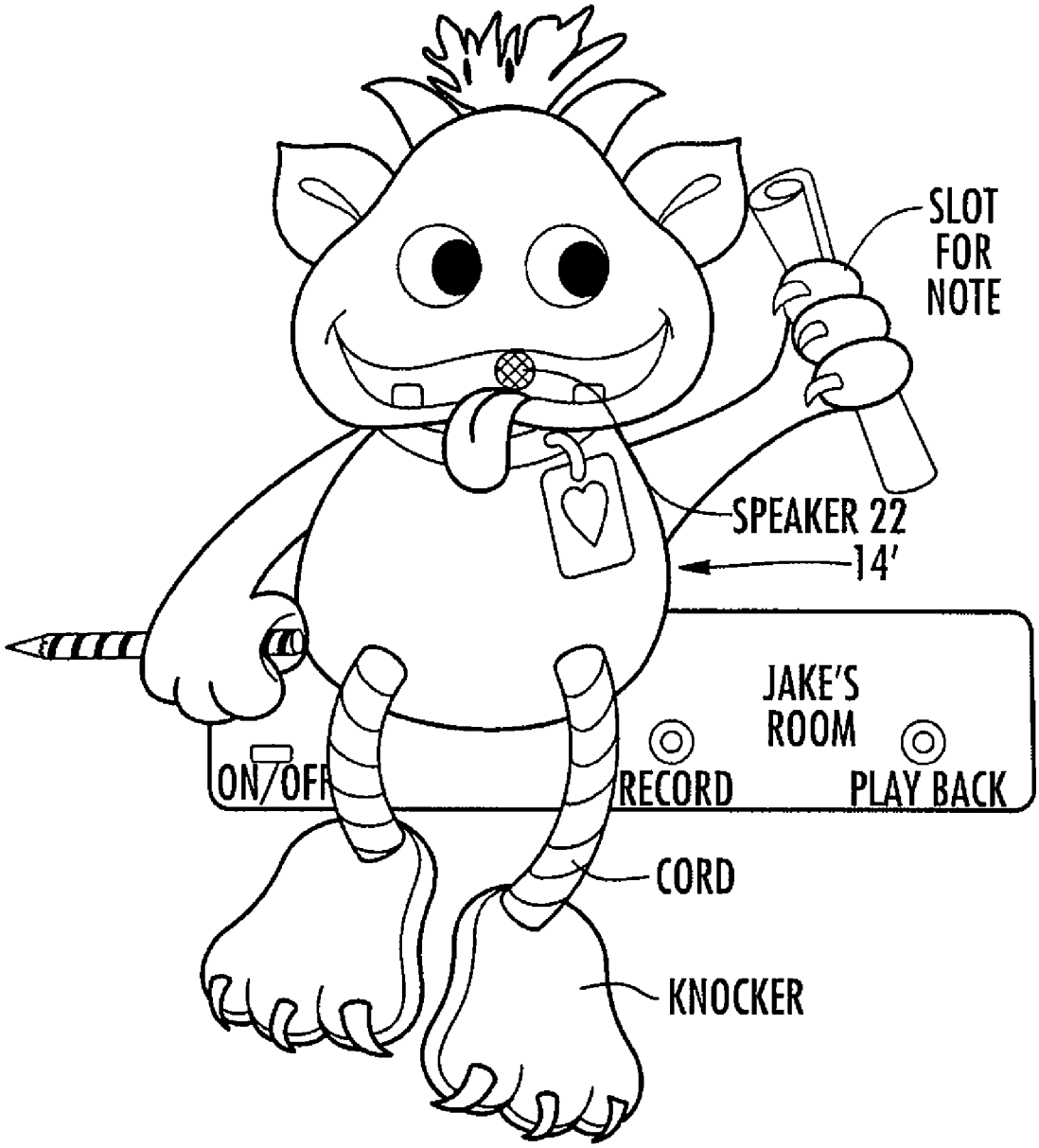
FIG. 5 shows a plane view of a door knocker formed according to a third embodiment.

FIG. 5 illustrates a third embodiment of a door knocker 10, in which the main body 14' is configured as a monster similar to that shown in FIG. 3B. In the embodiment shown in FIG. 5, a speaker 22 is provided, such as positioned in the mouth of the motif. One skilled in the art will appreciate that the main body portion 14, 14' can be configured as any of various other motifs, such as those described above.

In another embodiment, the construction kit 40 can comprise a plurality of main body portions 14, 14' representing different motifs, such a dog, a monster, etc. In one example, the construction kit 40 can include main body portions 14, 14' configured as girl dog (see FIG. 1A) and girl monster (see FIG. 3A), respectively. In the alternative, the plurality of main body portions 14, 14' can be configured as other seasonal, holiday, or other types of decorations (e.g., pumpkin, heart, Christmas tree, dreidel, basketball, etc.). The multiple main body portions 14, 14' can be formed so that they are interchangeable.

In a further embodiment, one or more additional main body portions 14, 14', with or without the related story book 82 (see FIG. 6) and/or the motif-oriented knock-knock jokes 84 (see, FIG. 6) can be formed as a sub-kit and sold separately. Knock-knock jokes may be provided to allow the same to be printed and inserted in label plate 34 formed on the door knocker 10. The construction kit may include personalized messages, which can be inserted on the label plate 34 formed on the door knockers 10. The personalized messages can include messages, such as "Today is Zach's Birthday," "Max's Room Is Off Limits To Girls," or "The Room of a Really Cool Dude!"

Figure 6:
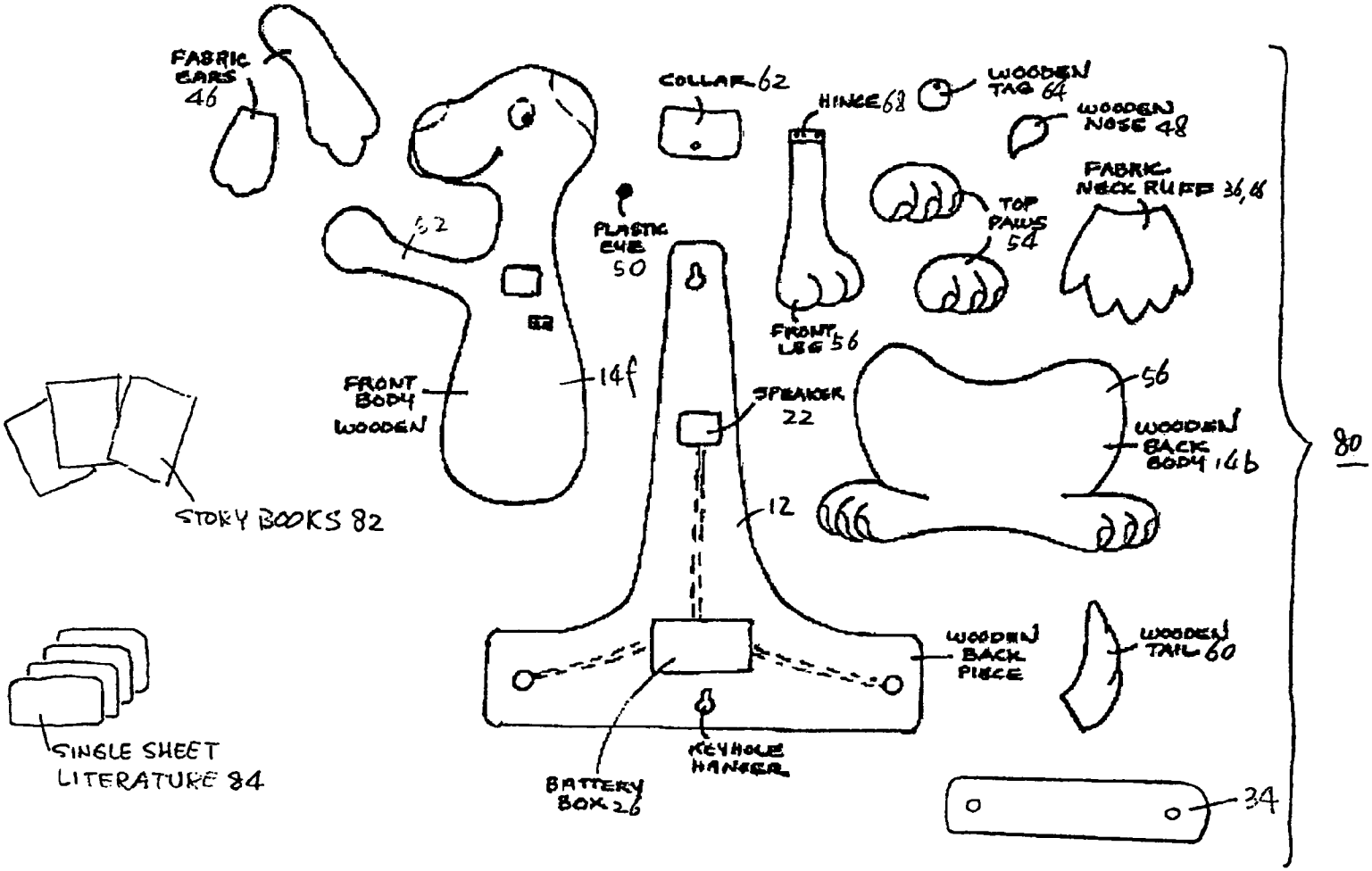
FIG. 6 shows an educational kit including a construction kit shown in FIG. 2.

FIG. 6 shows a door knocker educational kit 80, which can include one or more of the kit components such as a door knocker 10 or a construction kit 40 as described above. One or more story books 82 about privacy, which can include illustrations may be included in the educational kit 80. The story books 82 can be a series, which are adapted for different aspects about privacy or for different ages. Each story book 82 can be featured by a motif (e.g., dog, monster, dragon, pirate, etc.) as the lead character in a story centered on privacy.

As FIG. 6 illustrates the educational kit 80 may include single sheet literatures 84, such as stories about privacy and knock-knock jokes. The jokes can be based on one or more of the motifs included in the construction kit. For example, dog-related knock-knock jokes can be provided for a motif that looks like a dog). The single sheet literatures 84 can be in the form of cards, or otherwise be adapted to be inserted the name label slot provided on the door knocker 10 described above. A megaphone to amplify voices may also be part of the educational kit 80.

A door knocker can be formed in various ways by combining the kit components illustrated in FIG. 2. In a preferred embodiment, the base unit 12 can be painted and decorated and for the attachment of the back body 56 with one or more screws 42 or adhesive. The front body 14 is painted and or decorated and attached to the back body 56 and upper section of the base unit 12 with one or more screws 42 or adhesive. The knocker member 16 can be painted and decorated then attached using a hinge 68 that is then screwed to the front body 14 in the pre-drilled holes. A plurality of plastic eyes 50 is provided so that one preferred by the assembler can be attached to the front body 14 with adhesive. The nose 48 is then attached to the front body 14 with one or more screws 42 or adhesive. A set of fabric ears 46 are also attached to the front body 14, such as with adhesive.

The tag 64 is painted and or decorated and attached to the collar 62 with a clip. The collar 62 is painted or decorated and attached to the front body 14 at the neck area just below the head. The paws 54 are painted and or decorated and one is attached to the horizontally outstretched leg 52, while the other is attached to the leg that is the knocking member 16.

An electronic circuit is attached to the backside of the base unit 12 with the wiring fed through a set of troughs pre cut in the base unit 12 and secured with screws 42 into the pre-drilled holes. The speaker 22 and microphone 24 is set into the pre-cut hole in the base unit 12 and affixed with adhesive. The switches are inserted into the pre-drilled holes and secured with the included nuts and washers. The tail piece 60 is then painted and or decorated and attached to the backside of the back body 56 with one or more screws 42 or adhesive. The final step is to paint or affix self adhesive letters to the base unit 12 to spell a child's name.

The final assembled unit is then attached to a door at the appropriate operating height using standard commercially available screws or nails. A message can then be recorded.

As seen in FIGS. 1A and 1B, to operate one embodiment of the doorknocker 10, the knocking member 16 is grasped by hand and raised up in an arc. It is then either released or swung down to impact the front body 14. Upon impact, a loud noise is emitted naturally from the components and the trigger switch is caused to activate the playback of the recorded message. In addition, the horizontally outstretched leg 52 has a slot to hold messages that are written on a small piece of paper and then rolled and inserted into the slot 18*a* for future retrieval.

Having thus described at least illustrative embodiments of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed is:

1. A door knocker comprising:

a base portion supporting with a label plate, an integrated circuit board, a speaker, a message recorder and a playback button, wherein the integrated circuit board controls the speaker, the message recorder and the playback button;

a back body portion and a front body portion integrally connected to form a main body portion;

a knocking member comprising first and second ends wherein the first end can be pivotally connected to the main body portion, said main body portion being attached to the base portion;

a hinge mechanism that connects the knocking member to the main body portion; and wherein the main body portion has a slot for messages.

2. The door knocker of claim 1, wherein the base portion has a battery box.

3. The door knocker of claim 2, wherein the main body portion has a viewing port.

4. The door knocker of claim 3, wherein the main body portion can be in the shape of an animal.

5. The door knocker of claim 3, wherein the main body portion can be in the shape of a toy character.

6. The door knocker of claim 3, wherein the main body portion can be a sporting good.

7. The door knocker of claim 6, wherein the base portion and the main body can be decorated and painted.

* * * * *